US008558440B2

(12) United States Patent
Hartmann et al.

(10) Patent No.: US 8,558,440 B2
(45) Date of Patent: Oct. 15, 2013

(54) METHOD FOR APPLYING A PIN ON AN ELECTRODE BASE BODY

(75) Inventors: Detlef Hartmann, Bamberg (DE); Andreas Benz, Bamberg (DE)

(73) Assignee: Robert Bosch GmbH, Stuttgart (DE)

( * ) Notice: Subject to any disclaimer, the term of this patent is extended or adjusted under 35 U.S.C. 154(b) by 197 days.

(21) Appl. No.: 12/227,750

(22) PCT Filed: Jul. 27, 2007

(86) PCT No.: PCT/EP2007/057799

§ 371 (c)(1),
(2), (4) Date: Apr. 21, 2009

(87) PCT Pub. No.: WO2008/015179

PCT Pub. Date: Feb. 7, 2008

(65) Prior Publication Data

US 2009/0309476 A1 Dec. 17, 2009

(30) Foreign Application Priority Data

Aug. 4, 2006 (DE) ..... 10 2006 036 440

(51) Int. Cl.
*H01T 13/20* (2006.01)
*H01T 21/02* (2006.01)

(52) U.S. Cl.
USPC ..... 313/141; 445/7

(58) Field of Classification Search
USPC ..... 313/141, 143, 118; 445/7; 123/169 EL
See application file for complete search history.

(56) References Cited

U.S. PATENT DOCUMENTS

| | | | | |
|---|---|---|---|---|
| 4,840,594 | A * | 6/1989 | Moore | 445/7 |
| 5,273,474 | A * | 12/1993 | Oshima et al. | 445/7 |
| 5,527,198 | A | 6/1996 | Chiu et al. | |
| 6,132,277 | A | 10/2000 | Tribble et al. | |
| 7,740,513 | B2 * | 6/2010 | Mueller et al. | 445/7 |

FOREIGN PATENT DOCUMENTS

EP 0435202 7/1991

OTHER PUBLICATIONS

International Search Report, PCT International Patent Application No. PCT/EP2007/057799, dated Oct. 12, 2007.

* cited by examiner

*Primary Examiner* — Karabi Guharay
(74) *Attorney, Agent, or Firm* — Kenyon & Kenyon LLP

(57) ABSTRACT

A method is described for applying a pin made of a spark-erosion-resistant material, in particular of noble metal, onto a electrode base element. In order to achieve a large pin surface exposed to spark erosion, without increased material outlay for the pin, the pin is placed with one end surface onto the electrode base element and welded to it. The welded-on pin is then, by application of a compressive force engaging at the exposed end surface of the pin and directed toward the electrode base element, upset to a larger diameter.

17 Claims, 1 Drawing Sheet

METHOD FOR APPLYING A PIN ON AN ELECTRODE BASE BODY

FIELD OF THE INVENTION

The present invention relates to a method for applying a pin made of a spark-erosion-resistant material onto an electrode base element.

BACKGROUND INFORMATION

U.S. Pat. No. 6,132,277 describes that a pin made of noble metal, e.g., platinum, gold, iridium, palladium, rhodium, ruthenium, or an alloy of one or more of said metals, is cut off from a noble-metal wire, placed with the cut-off length onto the flat end surface of the electrode base element, and welded by resistance welding onto the electrode base element. A compressive force is then applied onto the welded-on pin, said force acting along the latter's axial length and being directed toward the electrode base element, and the pin is plastically deformed into a coin-like flat disk. The plastically deformed flat disk is welded once again using the resistance welding method, in order to secure each and every segment of the coin-like flat disk to the electrode base element.

SUMMARY

An example method according to the present invention may have the advantage that on the one hand, because of the small pin diameter upon welding of the pin onto the electrode base element, only a small quantity of the expensive spark-erosion-resistant material is melted in order to retain the pin on the electrode base element; and on the other hand, the subsequent upsetting of the welded-on pin results in an enlargement of the diameter of the pin, associated with a correspondingly large pin end surface that is exposed to spark erosion. A large end surface of the pin in turn increases the pin's service life. A much smaller quantity of spark-erosion-resistant material is required as compared with the welding on of a pin that already possesses the desired large diameter. The shortening of the pin associated with upsetting is compensated for by providing a corresponding initial length for the pin.

BRIEF DESCRIPTION OF THE DRAWINGS

An example method according to the present invention is explained in detail below, with reference to exemplifying embodiments of a spark plug that are depicted in the figures.

DETAILED DESCRIPTION OF EXAMPLE EMBODIMENTS

Figure 1:
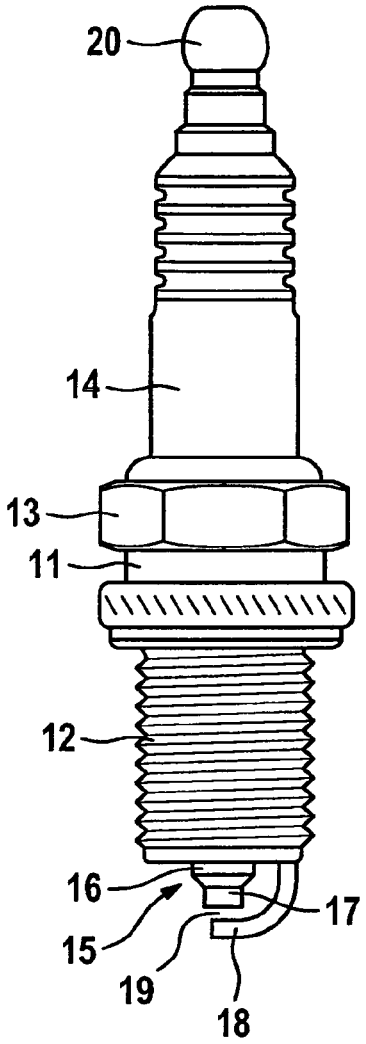
FIG. 1 is a side view of a spark plug for an internal combustion engine, having an electrode and a ground electrode.

The spark plug depicted in FIG. 1 has a metallic housing 11 having a screw-in thread 12 and an installation hex nut 13, as well as an insulator 14 made of, for example, an $Al_2O_3$ ceramic. Electrode 15 has an electrode base element 16 and a pin 17, made of electrically conductive material, protruding from electrode base element 16. As is apparent from the enlarged depiction of electrode 15 shown in FIG. 2, in the exemplifying embodiment described here, end segment 161 of the cylindrical electrode base element 16 is embodied as a cone or truncated cone, onto whose smaller-diameter covering surface pin 17 is welded. Pin 17 and end segment 161 of electrode base element 16 project out of insulator 14 on the lower side of housing 11. A ground electrode 18 joined to housing 11 is located opposite the exposed end surface 172 of pin 17, leaving a gap 19 to constitute a spark gap. Electrode 15 is connected in electrically conductive fashion to a connector stud 20, protruding from insulator 14, at the end of said insulator that faces away from pin 17.

In order to increase the service life of the spark plug, pin 17 is manufactured from spark-erosion-resistant material and is welded onto end segment 161 of electrode base element 16. This material can be a noble metal, i.e., a metal or several metals from the group of platinum, iridium, palladium, rhodium, ruthenium, or alloys therewith. The service life of the spark plug is influenced primarily by the end surface of pin 17 available for wear by spark erosion. An effort is therefore made to configure the pin with the largest possible diameter. Upon welding, however, a portion of the pin length is melted and serves for attachment to electrode base element 16. The thicker the pin, the greater the quantity of spark-erosion-resistant material that is melted for attachment when pin 17 is welded on. Because this material is relatively expensive, the diametrical size of pin 17 is limited for cost reasons.

Figure 2:
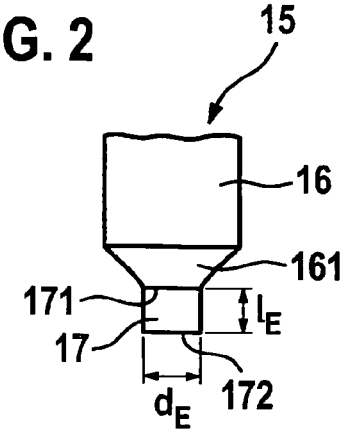
FIG. 2 is an enlarged depiction of an end segment of the electrode, with an electrode base element and upset noble-metal pin.
Figure 3:
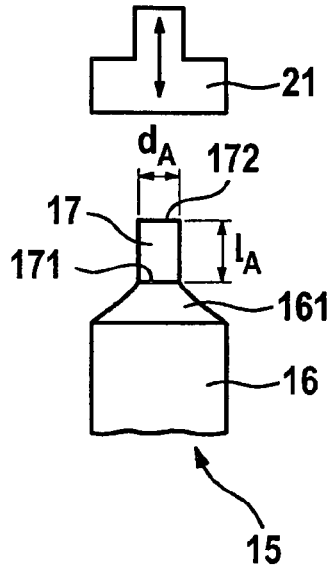
FIG. 3 is the same depiction as in FIG. 3, before upsetting of the noble-metal pin by the use of an upsetting tool.

In order to extend the service life of the spark plug without increasing the cost outlay for the spark-erosion-resistant material, pin 17 is applied onto electrode base element 16 using the following method:

Pin 17, having an initial length $l_A$ (FIG. 3), is placed with its one end surface 171 onto the flat end surface of end segment 161 of electrode base element 16, and welded to it. The welding method used is the laser welding method known per se, or the electron welding method. An upsetting tool 21 (FIG. 3) is then placed onto the other, exposed end surface 172 of pin 17 welded onto electrode base element 16, and pin 17 is upset, by application of a compressive force directed toward electrode base element 16, in such a way that its initial diameter $d_A$ (FIG. 3) increases to the desired final diameter $d_E$ (FIG. 2). A pin diameter increase from 5% to 80%, preferably between 20% and 50%, is aimed for in this context. Initial length $l_A$ of pin 17 (FIG. 3) is dimensioned so that when the desired final diameter $d_E$ of pin 17 is achieved, the desired final length $l_E$ of pin 17 is also established. A diameter $d_A$ between 0.3 and 2.5 mm, and a length $l_A$ between 0.5 and 2.5 mm, are selected as initial dimensions for pin 17 that is to be welded on. A final pin diameter $d_E$ between 0.4 and 3 mm, and a final pin length $l_E$ between 0.1 and 2 mm, are achieved by the upsetting of pin 17 with the increase in diameter that is aimed for.

In the exemplifying embodiment depicted, pin 17 has a cylindrical shape at its initial dimensions. By appropriate configuration of upsetting tool 21, the conformation of pin 17 is influenced or modified upon upsetting in such a way that the completely fabricated pin 17 acquires, for example, the shape of a prism having an oval or polygonal base outline.

Figure 4:
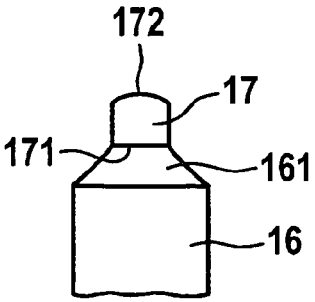
FIGS. 4-6 are each the same depiction as in FIG. 2, with a modified conformation of the upset noble-metal pin.
Figure 5:
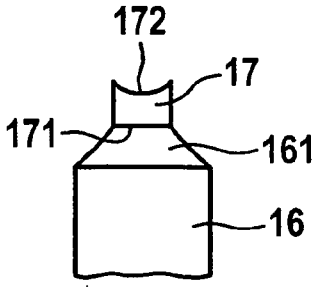
Figure 6:
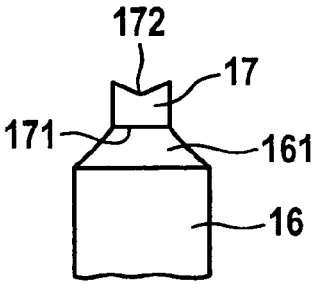

By appropriate configuration of upsetting tool 21, the exposed flat end surface 172 of pin 17 can additionally be contoured upon upsetting. Example of a deformation of the flat initial end surface 172 of pin 17 (FIG. 3) are depicted in FIGS. 4 to 6. By deformation upon the upsetting of pin 17, end surface can acquire a contour that is convex (FIG. 4), concave (FIG. 5), or notched (FIG. 6).

What is claimed is:

1. A method for applying a pin made of a spark-erosion-resistant material onto an electrode base element, comprising:

welding a first end of the pin onto an end segment of the electrode base element, the end segment projecting out of the electrode base element; and subsequent to the welding, applying a deformation force to a second end of the pin having a sole planar surface, the deformation force being directed toward the electrode base element to axially upset the pin thereby increasing a diameter of the pin.

2. The method as recited in claim 1, wherein the pin is welded onto the electrode base element by one of a laser welding method, or electron welding method.

3. The method as recited in claim 1, wherein the axial upsetting of the pin is carried out in such a way that the pin diameter increases in a range of 5% to 80%.

4. The method as recited in claim 3, wherein the pin diameter increases in a range of 20% to 50%.

5. The method as recited in claim 1, wherein an initial length of the pin to be welded onto the electrode base element is dimensioned so that when a desired final diameter of the pin is reached, the pin has a desired final pin length.

6. The method as recited in claim 5, wherein the pin to be welded onto the electrode base element has a diameter between 0.3 and 2.5 mm, and a length between 0.5 and 2.5 mm.

7. The method as recited in claim 6, wherein a final pin diameter between 0.4 and 3 mm, and a final pin length of the pin is between 0.1 and 2 mm.

8. The method as recited in claim 1, wherein with the axial upsetting of the pin, an exposed end surface of the pin is contoured.

9. The method as recited in claim 8, wherein the exposed end surface is notched or deformed in concave or convex fashion.

10. The method as recited in claim 1, wherein with the axial upsetting of the pin, the pin shape is modified.

11. The method as recited in claim 1, wherein an initial pin shape of the pin to be welded to the electrode base element is cylindrical.

12. The method as recited in claim 11, wherein the end segment of the electrode base element that receives the pin is formed to have the shape of a truncated cone, and a smaller-diameter covering surface of the truncated cone is adapted to an end surface of the pin.

13. The method as recited in claim 1, wherein the spark-erosion-resistant material is a metal or several metals from the group of platinum, iridium, rhodium, ruthenium, palladium, or alloys.

14. The method as recited in claim 13, wherein the method is used in the manufacture of a spark plug.

15. A spark plug, comprising:

an electrode that has an electrode base element; and a pin, made of a spark-erosion-resistant material, welded onto an end segment of the electrode base element, the end segment projecting out of the electrode base element, wherein the pin is welded with one end surface onto the electrode base element, and a second end of the pin having a sole planar surface and the pin diameter is plastically increased after the welding operation as a result of axial upsetting of the pin due to a deformation force applied at the second end of the pin having the sole planar surface.

16. The method as recited in claim 1, wherein a final shape of the pin is prism shaped.

17. The spark plug as recited in claim 15, wherein a final shape of the pin is prism shaped.

* * * * *

UNITED STATES PATENT AND TRADEMARK OFFICE

CERTIFICATE OF CORRECTION

PATENT NO. : 8,558,440 B2
APPLICATION NO. : 12/227750
DATED : October 15, 2013
INVENTOR(S) : Hartmann et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 312 days.

Signed and Sealed this
Fifteenth Day of September, 2015

Michelle K. Lee

Michelle K. Lee
*Director of the United States Patent and Trademark Office*